United States Patent [19]

Lofdahl et al.

[11] 3,996,888

[45] Dec. 14, 1976

[54] CLEANING AND LUBRICATING SYSTEM FOR FUSING APPARATUS

[75] Inventors: Clyde A. Lofdahl; Joseph H. Evans; Dave D. Nyberg, all of Santa Clara, Calif.

[73] Assignee: Raychem Corporation, Menlo Park, Calif.

[22] Filed: July 18, 1974

[21] Appl. No.: 489,709

[52] U.S. Cl. ..... 118/70; 118/104; 118/112; 118/115; 432/228

[51] Int. Cl.[2] ..... B05C 1/10

[58] Field of Search ..... 355/15; 118/60, 70, 118/104, 107, 112, 115, 637; 432/60, 228; 15/256.52; 101/425

[56] References Cited

UNITED STATES PATENTS

| | | | |
|---|---|---|---|
| 3,243,211 | 3/1966 | Wetmore | 403/28 |
| 3,552,850 | 1/1971 | Royka et al. | 355/15 |
| 3,597,372 | 8/1971 | Cook | 260/3 |
| 3,637,976 | 1/1972 | Ohta et al. | 15/256.52 |
| 3,649,992 | 3/1972 | Thettu | 355/15 |
| 3,669,707 | 6/1972 | Donnelly et al. | 432/60 |
| 3,731,358 | 5/1973 | Artl | 118/70 |
| 3,796,183 | 3/1974 | Thettu | 118/637 |
| 3,807,853 | 4/1974 | Hudson | 15/256.52 |
| 3,810,776 | 5/1974 | Banks et al. | 432/60 |
| 3,861,860 | 1/1975 | Thettu et al. | 15/256.52 |
| 3,861,861 | 1/1975 | Thettu | 15/256.52 |

*Primary Examiner*—Mervin Stein
*Assistant Examiner*—Douglas Salser
*Attorney, Agent, or Firm*—Lyon & Lyon

[57] ABSTRACT

An apparatus for lubricating and/or cleaning a heated fuser roller in a heat-pressure fusing system for electrophotographic copying. The apparatus includes a lubricating and/or cleaning means in contact with the heated fuser roll, the means including a cross-linked polymeric material on its outer surface. The polymeric material may have a leachable lubricating material dispersed therein, for controlled lubrication of the fuser roller. After depletion of the lubricating material, the cross-linked polymeric material then functions to remove and collect the toner particles from the surface of the toner fuser roller. The apparatus is preferably mounted in contact with the fuser roller by a means which permits easy removal and replacement in the field, after the lubricant has been depleted or the polymeric material has become saturated with toner particles.

10 Claims, 1 Drawing Figure

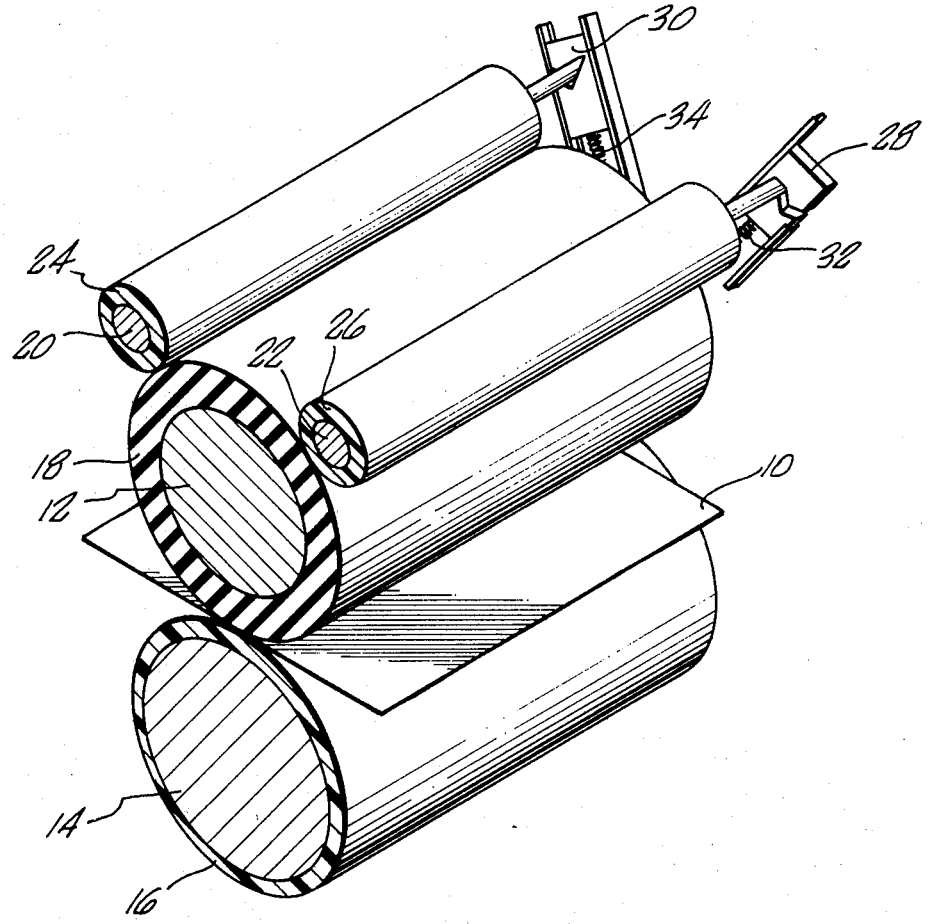
30
34
28
24
32
20
26
22
18
10
12
14
16

CLEANING AND LUBRICATING SYSTEM FOR FUSING APPARATUS

BACKGROUND OF THE INVENTION

This invention relates to electrophotographic copiers, and more particularly to an apparatus for lubricating or removing toner particles from a heated fuser roller. In the art of electrophotography, the usual method of carrying out a copying process is to electrostatically charge a surface and then expose it to a light pattern of an image to be reproduced, thereby discharging the charge in the areas where the light strikes the surface. The latent electrostatic image is then developed by contacting it with a finely divided electrostatically attractable powder material known in the art as a toner. The toner is held in the image areas not exposed to light which have retained the electrostatic charge. The powder image is then transferred to the surface of the final support material, such as paper, in paper copying. The support material with the powder thereon must then be fed to a fusing station, to permanently fuse the powder material onto the support.

One means of fusing or fixing the powder material onto the support is by means of heat and pressure, provided by passing the final support through a pair of rollers maintained in pressure contact. Heat is applied to either or both rollers by conventional means.

The electrostatically attractable powder, may be made of a wide variety of materials, but toners comprising a pigment such as carbon black dispersed in a thermoplastic material are particularly suited for this process. Typical toner powders are finely divided to permit electrostatic attraction and produce sharp images, and may for example consist of approximately 5 to 10% carbon black dispersed in a polystyrene thermoplastic binder. Complete transfer of such toners from the electrostatically charged surface to the paper, and complete retention by the paper through the fusing or fixing process have been difficult to maintain.

For example, a common method of transferring the dry image powder from the electrostatic surface to the support is by means of a developing drum, which in one rotation is charged, exposed to develop a latent image, developed with toner, and then brought into contact with the final support for the transfer of the imaged toner onto the support. In such a process, it has been necessary to provide means for cleaning the drum after toner transfer due to incomplete transfer of the toner onto the support. A wide variety of devices have been employed to clean residual toner from the electrostatic surface of the drum after transfer. These include brushes, webs, or squeegees which may be made of cross-linked polymeric materials, particularly elastomers, and may be in the form of a roll. For example, Kolb et al., U.S. Pat. No. 3,299,787, discloses a squeegee roll which may be formed from a natural or synthetic rubber to remove residual toner. Ruhland, U.S. Pat. No. 3,781,107, employs polyurethane foam for wiping of the developing drum. Since the toner is still in solid form and has not been subjected to sufficient heat to cause softening of the thermoplastic binder, a wide variety of devices and materials have been used with success to remove the dry powdered toner from the developing drum.

In contrast, through the fusion or fixing process, the toner is subjected to sufficient heat and pressure to cause softening of the thermoplastic binder and fusion onto the paper. The prior art has been plagued with problems in heat-pressure fixing processes using direct contact rollers in that the roller tends to pick up some of the fused toner from the paper and deposit it on another portion of the sheet, causing what is commonly called "offset". Due to this offset problem, many electrophotographic copying apparatuses have discarded the direct contact heated fusion roller approach and designed less efficient non-contact fixing processes such as radiant heating of the paper.

Solutions to this offset problem have been approached in two general ways. The first is the prevention of toner pickup by the fusion roller, and the second is the removal of the toner after pickup and before offset can occur. The first approach, i.e. prevention of toner pickup, has generally been accomplished by fabrication of the fuser roller with a material having high surface release property such as silicone rubber. For example, the use of a silicone elastomer blanket about the fusion roller, as in U.S. Pat. No. 3,669,707. Although such high surface release rollers have minimized the amount of toner pickup from the paper, they have not completely eliminated the problem. Thus, it has been found that additional lubrication of such rollers is necessary to eliminate the toner pickup for extended periods. For example, in U.S. Pat. No. 3,268,351 to Van Dorn, silicone oil is applied to a high release teflon fusion roller. A separate oil reservoir feeds a saturated felt pad, which in turn feeds an applicator roller which continuously lubricates the fusion roller. Such a device, although effective in preventing toner pickup while lubricated, suffers from the disadvantage that it requires constant maintanence to insure that there is an adequate supply of lubricating oil in the reservoir. Intricate oil reservoirs and wick assemblies have been devised as for example U.S. Pat. No. 3,745,972, which teaches a teflon-Nomex wick assembly, to increase the efficiency of the system. Nevertheless, once the lubricant is depleted, offset rapidly occurs.

The second approach recognizes that a certain amount of toner will adhere to the fusion roller, but attempts to alleviate the problem by providing a means of cleaning and removing the toner from the fusion roller surface. Unlike the cleaning of the developer drum where the powder is in dry, fine particulate form, loosely held to the developing drum by electrostatic force, in the cleaning of the fusion roller, the thermoplastic binder of the toner has been caused to melt and thereby form a more permanent bond with the fusion roller. Removal of the hot, coalesced toner material from the hot fusion roller is a much more difficult problem than that of cleaning a developer roller. For example, in U.S. Pat. No. 3,649,992 to Thettu, metal cylinders having a high thermal conductivity are employed to rapidly transmit the heat energy from the toner to the cylinders, which in turn causes the toner to solidify and transfer from the fusion roller to the metal cylinders. Such a cleaning apparatus, used in conjunction with a high release surface fusion roller has been found effective to prevent toner offset for extended periods. However, depending upon the operating conditions of the reproduction machine, offset still begins to appear after several thousand copies. Replacement of the metal rollers can be a costly and time consuming process. Although it is not fully understood under what set of condition offset begins to occur in such a system, it is believed that the high release surface fusion roller, after extended use, loses its release properties, and the metal roller eventually becomes sufficiently abraded and contaminated as not to be capable of removing all of the toner.

It is thus an object of this invention to provide a heat-pressure roller fusing system for fixing electrophotographic copies, which will operate for longer periods of time without offset than the systems of the prior art, and without the use of lubricating reservoirs.

It is another object of this invention to provide a fusing system wherein when offset begins to occur, it may be readily and inexpensively remedied in the field.

SUMMARY OF THE INVENTION

These and other objects are accomplished by providing a toner removing member having a cross-linked polymeric material on its outer surface, the outer surface of the member being in contact with the fuser roller. The cross-linked polymer material removes toner particles carried on the surface of the fuser roller at a greater rate and for longer periods than prior art cleaning means, such as metal roller. More significantly, these objects are accomplished by providing rollers which lubricate and/or clean the fusion roller. Specifically, a member having on its outer surface a cross-linked polymeric material compounded with a leachable lubricating material is mounted in contact with the fusion roller, whereby the polymeric member lubricates the fusion roller to prevent toner particle pickup until the leachable lubricant is depleted and thereafter removes toner particles from the fuser roller.

A combination lubricating and cleaning member may substantially increase the number of copies which can be run before toner offset, since it can operate in two separate modes. A separate lubricating reservoir is not required, although periodic changing of the lubricating members ensures a sufficient supply of lubricant to the fuser roller. However, even when the lubricating member has been depleted of lubricant, it has been found to act as an effective cleaning member for preventing toner offset for a period of time greater than prior art cleaning devices, such as metal rolls.

It should thus be apparent, that a member fabricated so as to effectively lubricate the fusion roller for an extended period, and after the lubricant is depleted, effectively clean the fuser roller for an extended period, outperforms and outlasts fuser roller systems of the prior art which have only lubricating or cleaning means to prevent offset.

BRIEF DESCRIPTION OF THE DRAWINGS

FIG. 1 is a perspective view of a toner fusing system, having roller members with cross-linked polymeric materials on their outer surface for lubricating or cleaning toner from the fuser roller.

PREFERRED EMBODIMENT

Referring to the figure, the support member 10, having toner deposited thereon, is fed between rollers 12 and 14 to permanently fix the toner to the support via heat and pressure. Back-up roller 14, having a baked teflon coating on its outer surface, 16, maintains the support in a pressure relationship with fusion roller 12. Fusion roller 12 is provided with a heating means, not shown, which maintains the roller at a constant temperature. The precise temperature of course, will depend upon the fusion temperature of the toner, but generally, toner fusion is accomplished without burning of the paper at about 170° C. Heated fuser roller 12, contacts and fuses toner particles previously deposited in the desired pattern by a developing drum, not shown, to the paper. On the outer surface of roller 12, is a high release material such as a RTV Silicone Rubber, 18. The use of the silicone rubber on the outer surface minimizes the amount of tone pickup from the paper, but does not completely eliminate it.

In order to ensure that any toner picked up by roller 12, will not be redeposited by the roller on another portion of the paper, resulting in offset, as well as to further minimize toner pickup, rollers 20 and 22 are positioned in contact with fusion roller 12. On the outer surface of rollers 20 and 22 is provided a cross-linked polymeric material, 24 and 26, which is functional at the elevated temperature of the fuser roller. Although a wide variety of cross-linked polymeric materials may be employed as the outer surface of those rollers, polyethylene and ethylene copolymers (ethylene with vinyl acetate, ethyl or methyl acrylate and propylene) have been found particularly suitable. It should be noted that, non-crosslinked polymeric materials are unsuited for this application. Even if the polymer is of the high temperature variety, it will tend to become fusible at the elevated temperatures of the fuser roller, depositing upon and contaminating the fuser roller instead of cleaning it. Thus, although a thin layer of toner material is suggested as an outer layer of a cleaning roller in U.S. Pat. No. 3,649,992, it suffers from the disadvantage that the toner comprises a non-cross-linked polymeric binder and is thus not in accordance with this invention. Other cross-linked polymeric materials suitable for this application include polyvinyl chloride and vinyl chloridel vinyl acetate copolymers, polyurethane, chlorinated and chlorosulfonated polyethylene, polyethylene, polychloroprene, acrylonitrile-butadiene copolymers, acrylic and methacrylic polymers, styrene-butadiene copolymers of either radom or block constitution, styrene-silicone or $\alpha$-methylstyrene-silicone block copolymers, polyester based elastoplastic block copolymers, fluoro hydrocarbon elastomers and butyl rubber.

Unlike a metal roller, the polymeric material on the outer surface is capable of absorbing a much greater amount of toner particles thereby allowing a greater number of copies to be run before replacement. Particularly suited for this application, are heat-shrinkable polymeric materials which have been inserted over rollers 20 and 22 and then heat-shrunk. Thus, when outer coverings 24 and 26 have become completely saturated with toner, or depleted of lubricant as later discussed, they may be quickly and inexpensively replaced by placing fresh heat-shrinkable material over the inner rollers and rapidly shrinking them onto the inner roller. For rapid and simple replacement of rollers 20 and 22 in the field, the rollers may be mounted at each end in slotmountings, 28 and 30 which are spring-biased via springs 32 and 34 to maintain the rollers in frictional contact with the fuser roller 12. Roller replacement is easily accomplished by releasing the spring and slipping the roller from the slots. The used polymeric covering can then be removed from rollers 20 and 22 and fresh material shrunk thereover. Cross-linked polymeric materials which may be rendered heat-shrinkable are well known in the art, as for example, in U.S. Pat. Nos. 3,243,211 and 3,597,372.

To permit the use of rollers 24 and 26 for even longer periods, i.e. greater than 20,000 copies before replacement, polymeric material 24 and 26 may be compounded with a material which leaches out and lubricates fusion surface 18 so as to prevent toner pickup. After the lubricating material has been depleted, the rollers then function to remove and collect toner from the fusion roller. By allowing the rollers to act first as a lubricating rollers, and then as cleaning rollers, longer times between replacement is possible.

A wide variety of lubricating materials may be utilized in accordance with this invention. However, such materials should be sufficiently compatible with the polymeric systems so it can be compounded therewith, and should be slowly leachable out of polymeric composition so as to lubricate the fuser roller over an extended period of time. Lubricants particularly suited for this application include those commonly called "external lubricants" by those skilled in the compounding art.

Although many materials may possess both internal and external lubricating properties, and the degree of internal vs external lubricating properties will depend upon a number of factors, true external lubricants have very little resin solubility. For a more complete discussion of lubricants which may exhibit external lubricating properties, see Modern Plastic Encyclopedia, Vol. 50, No. 10A, 1973, pp. 248–250. Particularly suitable as lubricants for this invention are esters of carboxylic acids with univalent alcohols such as distearyl or dilauryl thiodipropionate; aliphatic substituted phenolics such as tetrakis [methylene-3-(3′,5′-di-t-butyl-4′-hydroxyphenyl) propionate] methane; metallic soap lubricants such as zinc stearate; fatty acids and their derivatives; silicone oils such as polydimethylsiloxane or surfactants such as poly (dimethylsiloxy) stearoxy siloxane.

The lubricating materials may comprise from 1 to 40% of the polymeric composition and more particularly from 2 to 20%. Also, a wide variety of inorganic fillers, well known in the plastic compounding art, may be utilized to add toughness and abrasion resistence to the composition. Preferably, from 5 to 40% filler based on total composition is employed.

Also, although dual cleaning/lubricating rollers are shown in the preferred embodiment, it will be understood that a fewer or greater number of rollers may be employed in accordance with this invention. Also, the system may be so designed that one of the rollers acts as a cleaner while the other acts as a lubricator.

Finally, although the preferred embodiment contemplates an inner metal roller having the polymeric material thereover, it will be understood that the cleaning-/lubricating means may be fashioned from a one piece polymeric construction.

The invention will become apparent from the following specific examples.

EXAMPLE 1

A cross-linked, heat-shrinkable sleeve was compounded from the following ingredients:

| | |
|---|---|
| Ethylene-Vinyl Acetate | 47% |
| Inorganic Filler | 38% |
| Other Additives (antioxidants, stabilizers) | 15% |

The sleeve was positioned and heat shrunk over a metal roller and placed in contact with a silicone rubber fusion roller of an electrophotographic copying machine.

A machine having metal rollers in contact with the fusion roller was operated under similar conditions. After about 5,000 copies, both machines were inspected. The roller containing the cross-linked polymeric sleeve was quite dark, indicating efficient toner pickup, while the fuser roller of this machine was clean. In contrast, the machine having the fuser roller in contact with the metal cleaning roller was significantly darker, indicating less efficient toner pickup.

After 10,000 copies, some machines using the standard metal roller began to produce copies exhibiting offset. In contrast, no offset was discernable after 10,000 copies in machines using the cross-linked polymeric cleaning roller.

EXAMPLE II

A cross-linked heat-shrinkable sleeve was compounded from the following ingredients:

| | |
|---|---|
| Ethylene-Vinyl Acetate Copolymer | 90% |
| Inorganic Filler | 3% |
| Tetrakis [Methylene 3-(3′,5′ di-t-butyl-4′Hydroxy phenyl) Propionate] Methane | 1.75% |
| Mixed Fatty Acid Ester of Thiodipropionate | 3.50% |
| Other Additives | 1.75% |

The sleeve was heat shrunk over a metal roller and tested as per Example I. After 5,000 copies, both the cross-linked polymeric material and the fusion roller were clean, indicating that the fusion roller had been sufficiently lubricated to prevent toner pickup from the paper.

After 10,000 copies, the fusion roller remained clean while the cross-linked sleeve showed signs of toner pickup, indicating that the lubricant had been depleted, so the sleeve was then functioning to clean the fuser roller.

After 15,000 copies, the fusion roller remained clean while the cross-linked polymeric sleeve exhibited considerably toner pickup. No offset on the paper was discernable.

EXAMPLE III

A cross-linked polymeric heat-shrinkable sleeve was compounded from the following ingredient:

| | |
|---|---|
| Low Density Polyethylene | 75% |
| Ethylene Vinyl Acetate Copolymer | 13% |
| Tetrakis [Methylene 3-(3′5′ di-t-Butyl-4′ Hydroxyphenyl) Propionate] Methane | 1.27% |
| Mixed Fatty Acid Ester of Thiodipropionate | 4.36% |
| Other Additives | 1.37% |

The sleeve was tested as per Example II and exhibited similar results.

It will be understood that the number of copies which can be run before toner offset occurs will vary widely, depending upon the operating conditions of the machine, but we have found that fusion rollers being cleaned or lubricated by the cross-linked polymeric materials of the invention, consistently exhibit cleaner surfaces for a greater period of time when compared with rollers not having a cleaning or lubricating member as well as cleaning members having metal on their outer surfaces.

What is claimed is:

1. An apparatus for lubricating and cleaning the surface of a toner fuser roller including a cleaning roller rotatably mounted and in contact with the surface of said fuser roller, the cleaning roller having a cross-linked polymeric material on its outer surface and said polymeric material having dispersed therein a leachable lubricating material, whereby the cleaning roller lubricates said fuser roller to prevent toner particle pickup until said leachable lubricant is depleted and thereafter removes toner particles from said fuser roller.

2. The apparatus of claim 1 wherein the leachable lubricating material is selected from the group consisting of esters of carboxylic acids with univalent alcohols, aliphatic substituted phenolics, metallic soaps, fatty acids and their derivatives and silicone oils.

3. The apparatus of claim 2 wherein the lubricant is distearylthiodipropionate.

4. The apparatus of claim 2 wherein the lubricant is tetrakis[methylene-3-(3′,5′-di-t-butyl-4′-hydroxyphenyl) propionate] methane.

5. The apparatus of claim 2 wherein the lubricant is zinc stearate.

6. The apparatus of claim 2 wherein the lubricant is polydimethylsiloxane.

7. The apparatus of claim 2 wherein the lubricant is poly(dimethylsiloxy) stearoxy siloxane.

8. The apparatus of claim 1 wherein the polymeric material is in the form of a heat-shrinkable sleeve which has been shrunk over an inner roller.

9. The apparatus of claim 1 wherein the cleaning roller is spring-biased so as to be in frictional contact with the fuser roller.

10. The apparatus of claim 1 having a plurality of cleaning rollers.

* * * * *